US008168059B2

(12) United States Patent
Stefanini

(10) Patent No.: US 8,168,059 B2
(45) Date of Patent: May 1, 2012

(54) INHIBITION OF CORROSION OF STRUCTURES

(75) Inventor: Daniel Stefanini, Beeston (GB)

(73) Assignee: Hydropath Holdings Limited, London (GB)

( * ) Notice: Subject to any disclaimer, the term of this patent is extended or adjusted under 35 U.S.C. 154(b) by 302 days.

(21) Appl. No.: 12/529,452

(22) PCT Filed: Feb. 29, 2008

(86) PCT No.: PCT/GB2008/000692

§ 371 (c)(1),
(2), (4) Date: Sep. 1, 2009

(87) PCT Pub. No.: WO2008/107644

PCT Pub. Date: Sep. 12, 2008

(65) Prior Publication Data

US 2010/0101933 A1 Apr. 29, 2010

(30) Foreign Application Priority Data

Mar. 2, 2007 (GB) ..... 0704042.1

(51) Int. Cl.
*C23F 13/04* (2006.01)

(52) U.S. Cl. ..... 205/740; 205/725; 205/735; 205/736

(58) Field of Classification Search ..... 205/724, 205/725, 726, 727, 735, 736, 740; 204/196.01, 204/196.29, 196.37
See application file for complete search history.

(56) References Cited

U.S. PATENT DOCUMENTS

| | | | | |
|---|---|---|---|---|
| 5,269,915 | A * | 12/1993 | Clair | 210/222 |
| 5,407,549 | A | 4/1995 | Camp | |
| 5,935,433 | A | 8/1999 | Stefanini | |

FOREIGN PATENT DOCUMENTS

| | | |
|---|---|---|
| EP | 0357102 | 3/1990 |
| EP | 1598445 | * 11/2005 |
| GB | 2297051 | 7/1997 |
| GB | 2421449 | 6/2006 |
| WO | 2006067418 | 6/2006 |
| WO | 2007015684 | 2/2007 |

* cited by examiner

*Primary Examiner* — Bruce Bell
(74) *Attorney, Agent, or Firm* — Kirschestein et al.

(57) ABSTRACT

A method for inhibiting corrosion in at least one required region of an elongate metal structure, comprising applying a high-frequency electromagnetic signal to the structure in a manner such that a voltage standing wave is established in the structure with a corrosion-inhibiting potential at the required region(s) of the structure. The method is advantageously applied to an oil well riser pipe, to inhibit corrosion of the external surface thereof in the vicinity of an oil production zone.

8 Claims, 1 Drawing Sheet

INHIBITION OF CORROSION OF STRUCTURES

Priority: This application is a U.S. National Stage Application of International Application No. PCT/GB2008/000692 filed 29 Feb. 2008 and claims priority from Great Britain application No. 0704042.1, filed 02 Mar. 2007, the contents of each of which are incorporated herein by reference in their entirety.

BACKGROUND OF THE INVENTION

This invention relates to the inhibition of corrosion of structures. The invention has been devised for corrosion inhibition in relation to underground structures, particularly pipework in oil production installations. However, it is to be appreciated that the invention could be applicable more generally, in structures where similar or analogous problems, as described hereafter, arise.

The extraction of oil from underground sources is, in principle, straightforward: a hole is drilled down to an oil bearing stratum in the ground and pipework placed in the hole through which oil can be raised to ground surface level. In some oil wells the oil may be under pressure in the oil-bearing stratum so it flows to the surface without any assistance, but in most cases assistance is required, frequently by the injection of water, through a further pipe, to the oil bearing stratum to displace the oil. The oil then comes to the surface mixed with the water. The water injected to the oil bearing stratum may be sea water, and may be heated so that the oil, if viscous, flows more readily. It will be appreciated that such production techniques produce an environment which is highly conducive to corrosion of steel pipework and components.

The parts of an oil well most prone to corrosion are production zones in which pipework is in contact with the oil-water mixture. The length of the exterior of a well pipe exposed to the mixture is as wide as the production zone. In any well, there may be more than one production zone, the zones being at different depths from one another, and oil production may be switched from one zone to another when the available oil in one zone is depleted. In addition, the inside of the riser pipe which conveys the oil-water mixture to the surface is prone to corrosion.

Corrosion of metals is an electro-chemical process, involving the passage of electrical currents of a greater or lesser magnitude. Where a metal surface is in contact with an electrolyte, differences in potential which arise between different parts of the metal surface, due to metallurgical variations in the material at different places, or local differences in the environment (such as variations in the availability of oxygen at the surface) establish electrochemical cells at which the corrosion process consumes the metal at the anodes. One known technique for inhibiting corrosion is known as cathodic protection, which involves the provision and connection of an external anode to the metal which is to be protected, so that the metal effectively becomes the cathode, and thus does not corrode. The external anode may be a galvanic anode (a metal more reactive than the metal which is to be protected; generally zinc, aluminium, magnesium, or an alloy thereof where it is steel which is to be protected). In this case, the difference in natural potential between the anode and the steel causes an electron flow in the electrolyte from the anode to the steel. At the steel, because the electrical potential between it and the electrolyte solution is, in effect, made more negative by the supply of electrons, corrosive anodic reactions are stifled and only cathodic reactions can take place. The anode or anodes are referred to as sacrificial anodes, as they are consumed in the process.

An alternative protection technique is to employ one or more inert (non-consumable) anodes and use an external source of DC electrical power to impress a current on the anode-cathode system, to achieve the same effect.

In general terms, what is required is to inhibit anodic reactions, either by establishing a zero potential at the surface to be protected or, in conventional cathodic protection, a negative potential which ensures the surface does not become an anode.

Cathodic protection, by the use of sacrificial anodes or by impressed current, is widely used for the protection of structures such as storage tanks, jetties, off shore structures, or reinforced concrete structures where corrosion of the steel reinforcement is a potential problem.

Oil wells present problems so that known cathodic protection systems are not readily applied thereto. Down-well access for the replacement of sacrificial anodes is not possible, while standard impressed-current cathodic protection is not readily applicable. An external anode will only afford protection for a distance along a pipe of not more than two to five pipe diameters, and since the production zone may be moved during the life of a well the establishment of a fixed zone of protection is not useful.

Accordingly, it is the object of the present invention to provide for corrosion inhibition in production zones of oil wells, particularly of the exterior of well pipework, or analogous situations, wherein the above-described disadvantages are overcome or reduced.

SUMMARY OF THE INVENTION

According to one aspect of the invention, we provide a method for inhibiting corrosion in at least one required region of an elongate metal structure, comprising applying a high-frequency electromagnetic signal to the structure in a manner such that a voltage standing wave is established in the structure with a corrosion-inhibiting potential at the required region(s) of the structure. Preferably the method includes the step of adjusting the frequency of the electromagnetic signal (and hence the wave length of the voltage standing wave) so that a node point (zero volts) is established in the vicinity of a required region of corrosion inhibition.

Preferably the elongate metal structure is an oil well riser pipe, and the signal is applied thereto at the well head (i.e. where the pipe emerges from the ground). The down-well riser pipe, and a pipe leading therefrom, e.g. a delivery pipeline, effectively form a dipole aerial in which the standing wave is established, the signal being reflected from the down-well end of the pipe. The frequency, phase, and direction of the applied signal may be adjusted so that the oil-production zone of the well will be close to a node of the standing wave.

As mentioned above, the oil production zone of a well may be changed several times during the life of a well. In accordance with the invention, suitable adjustment of the frequency, phase, and direction of the signal applied to the well can ensure that the required corrosion-inhibiting condition is established in the (current) production zone.

The frequency of the signal may be varied in use so that the position of the node point varies with time. By this means, corrosion may be inhibited over an increased length of the well.

Preferably the electromagnetic signal is applied to the structure by providing a core element of magnetically conductive material surrounding the structure at an appropriate position, and establishing a magnetic flux of the required frequency in the core element for establishing the standing wave. The magnetic flux may be established by providing a coil through which the magnetically conductive core element passes, the coil being energised by electrical signals of the required frequency.

A computer program can be written to calculate the correct frequency to establish the necessary standing wave and node position for the depth of the well and the position of the production zone therein.

In accordance with the invention, the establishment of the required potential in the production zone by the standing wave provides an effect analogous to cathodic protection of the exterior surface of the riser pipe in that zone. In addition, a co-axial magnetic field is established along the length of the riser pipe producing a skin-effect corrosion inhibition action on the inner surface thereof.

According to another aspect of the invention, we provide apparatus for inhibiting corrosion of at least one required region of an elongate metal structure, comprising means for applying a high frequency electromagnetic signal to the structure at a position in the length thereof, whereby a voltage standing wave is established in the structure, and means for adjusting the signal frequency and hence wavelength of the standing wave.

Preferably, the apparatus includes a core element of magnetically conductive material for surrounding the structure, and means for establishing a high-frequency magnetic flux in the core element.

BRIEF DESCRIPTION OF THE DRAWINGS

The invention will now be described by way of example with reference to the accompanying drawings, of which.

DETAILED DESCRIPTION OF THE PREFERRED EMBODIMENTS

Figure 1:
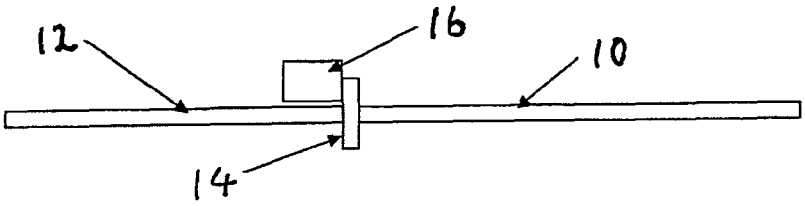
FIG. 1 illustrates diagrammatically how apparatus according to the invention could be applied for inhibiting corrosion of oil well structures.

Referring firstly to FIG. 1 of the drawings, a pipe extending down an oil well is indicated at 10, and a pipeline extending from the well head at 12. At the well head, an annular core element 14 of magnetically conductive material, e.g. ferrite, is illustrated extending around the pipe 10, and a signal generator producing an electrical output at the required frequency is shown at 16. The output from the signal generator 16 is applied to a coil, not shown, through which the magnetically conductive core element extends as well as extending around the pipe 10 (12). The output of the signal generator 16 is an alternating signal, of adjustable frequency.

An illustrative arrangement of a magnetically-conductive core element surrounding a pipe is disclosed in international patent application publication no. WO 2006/067418, although it is for a different purpose and utilises two core elements spaced lengthwise of the pipe. Nevertheless the arrangement of such a core element is usable, in principle, in the present invention, if a signal generator whose output frequency is adjustable is employed.

Figure 2:
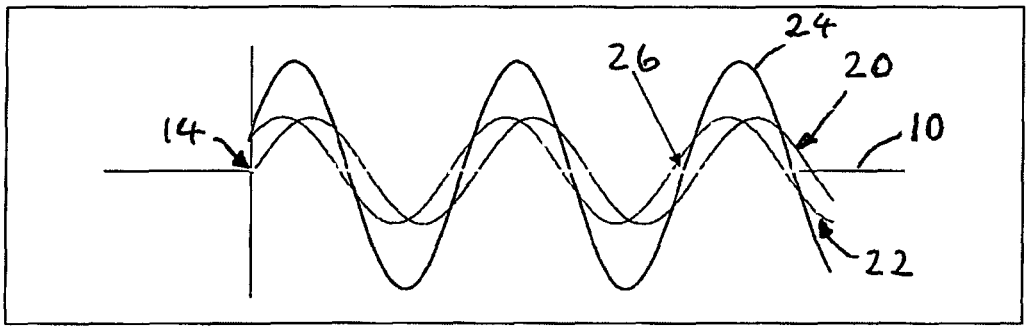
FIG. 2 illustrates standing wave conditions occurring in use of the invention.

FIG. 2 of the drawings illustrates diagrammatically the standing wave conditions which are established in the well pipe 10 in use. In this drawing, the position of the core element 14 at the well head is indicated, and the alternating (sinusoidal) signal produced thereby is indicated by the line 20. The signal reflected back from the end of the well is represented by the line 22: the standing wave resulting from the addition of the applied and reflected signal is indicated by the sinusoidal line 24. At a signal frequency of 120 kHz, the wave length of the standing wave is approximately 2.5 km. By altering the frequency, the wavelength is correspondingly changed so that the nodes (zero points) of the resultant of the forward and reflected waves are established at different points lengthwise of the well pipe. The frequency would be adjusted until a node is established in the region of a production zone of the oil well, so that inhibition of corrosion of the external surface of the well pipe is achieved in that zone.

By maintaining the potential in the production zone close to zero, surfaces of the pipe can act only as cathodes, so anodic corrosion reactions are inhibited.

In an oil well, the thickness of production zones can vary greatly, for example from 1 meter to 100 meters or more. In general, in accordance with the invention a node of the standing wave, as shown at 26 in FIG. 2, would be arranged to occur about half way through the thickness of the production zone. Although the potential established by the standing wave is positive and negative on opposite sides of the node, in the direction of the length of the well pipe, for typical production zone thicknesses the potential within the production zone is close enough to zero (bearing in mind the magnitude of the wave length as explained above) for corrosion to be inhibited throughout the thickness.

It would be possible for the frequency and hence wavelength of the standing wave to be varied slightly with time so that the node position varies, in any required pattern, with time along the length of the well pipe. By this means, some inhibition of corrosion of the external surface of the pipe can be achieved over a greater length of the pipe.

In addition, by the skin effect of the co-axial magnetic field induced in the pipe extending upwardly from the production zone to the well head, electrons are displaced from the interior surface of the pipe so that it is effective as a cathode, inhibiting corrosion of the interior surface.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of inhibiting corrosion in at least one required region of an elongate metal structure, comprising: applying a high-frequency electromagnetic signal to the structure in a manner such that a voltage standing wave is established in the structure with a corrosion-inhibiting potential at the at least one required region of the structure, the electromagnetic signal being applied to the structure by providing a core element of magnetically conductive material surrounding the structure, and by establishing a magnetic flux of a required frequency in the core element for establishing the standing wave, the magnetic flux being established by providing a coil through which the magnetically conductive core element extends, and by energizing the coil with electrical signals at the required frequency.

2. The method according to claim 1, and comprising adjusting a frequency of the electromagnetic signal so that a node point of the standing wave is established in a vicinity of a region of corrosion inhibition.

3. The method according to claim 2, and comprising varying a frequency of the electromagnetic signal in use so that a position of the node point varies with time.

4. The method according to claim 1, and configuring the elongate metal structure as an oil well riser pipe.

5. The method according to claim 4, and applying the electromagnetic signal to the pipe at a well head.

6. A method of inhibiting corrosion of at least an external surface of an oil well riser pipe in a region of a production zone of an oil well, comprising:

applying a high-frequency electromagnetic signal to the riser pipe in such a manner that a voltage standing wave is established in the pipe; and adjusting a frequency of the electromagnetic signal so that a node point of the standing wave is established in a vicinity of the production zone, the magnetic flux being established by providing a coil through which a magnetically conductive core element extends, and by energizing the coil with electrical signals at a required frequency.

7. The method according to claim 6, and applying the electromagnetic signal to the pipe by surrounding the pipe with the core element of magnetically conductive material, and by establishing a magnetic flux of the required frequency in the core element for establishing the standing wave.

8. The method according to claim 6, and varying the frequency of the electromagnetic signal in use so that a position of the node point varies with time.

* * * * *